US007834799B1

(12) United States Patent
Wells

(10) Patent No.: US 7,834,799 B1
(45) Date of Patent: Nov. 16, 2010

(54) SYSTEM AND METHOD FOR FABRICATING COMPOSITE LAMINATE STRUCTURES WITH CO-LAMINATED RADAR ABSORBING MATERIAL

(75) Inventor: Cliff Wells, Grass Valley, CA (US)

(73) Assignee: Composite Engineering, Inc., Sacramento, CA (US)

( * ) Notice: Subject to any disclaimer, the term of this patent is extended or adjusted under 35 U.S.C. 154(b) by 354 days.

(21) Appl. No.: 12/154,601

(22) Filed: May 23, 2008

(51) Int. Cl.
*H01Q 17/00* (2006.01)

(52) U.S. Cl. ..... 342/1; 342/2; 342/3; 342/4

(58) Field of Classification Search ..... 342/1, 342/2, 3, 4, 13
See application file for complete search history.

(56) References Cited

U.S. PATENT DOCUMENTS

| | | | | | |
|---|---|---|---|---|---|
| 3,054,428 | A * | 9/1962 | Crawford | 138/141 |
| 3,806,928 | A * | 4/1974 | Costanza | 342/4 |
| 4,390,489 | A * | 6/1983 | Segal | 264/126 |
| 4,960,633 | A * | 10/1990 | Hiza et al. | 428/215 |
| 5,089,348 | A * | 2/1992 | Louderback | 428/464 |
| 5,323,160 | A * | 6/1994 | Kim et al. | 342/1 |
| 5,389,434 | A * | 2/1995 | Chamberlain et al. | 428/323 |
| 5,413,027 | A | 5/1995 | Mixon | |
| 5,552,455 | A | 9/1996 | Schuler et al. | |
| 6,111,534 | A | 8/2000 | Escarmant | |
| 6,411,248 | B1 | 6/2002 | Barbour et al. | |
| 6,486,822 | B1 | 11/2002 | Peterman | |
| 6,518,911 | B2 | 2/2003 | Strait | |
| 7,112,299 | B2 | 9/2006 | Merrick | |
| 7,551,117 | B2 * | 6/2009 | Asaba | 342/1 |
| 2004/0021597 | A1 * | 2/2004 | Dvorak et al. | 342/1 |
| 2005/0140539 | A1 * | 6/2005 | Fujieda et al. | 342/1 |
| 2006/0007034 | A1 * | 1/2006 | Yen et al. | 342/1 |
| 2008/0131609 | A1 * | 6/2008 | Vargo et al. | 427/404 |

* cited by examiner

*Primary Examiner*—John B Sotomayor
(74) *Attorney, Agent, or Firm*—Jim H. Salter

(57) ABSTRACT

Various embodiments provide systems and methods for fabricating composite laminate structures with co-laminated radar absorbing material. An example embodiment includes providing a component part fabricated from composite laminate and having an inside surface and an outside surface; providing a portion of radar absorbing material (RAM) having an inside surface and an outside surface; positioning the outside surface of the component part against the inside surface of the portion of RAM to form an assembly; and applying pressure to the assembly thereby causing the portion of RAM to bond to the outside surface of the component part.

20 Claims, 22 Drawing Sheets

SYSTEM AND METHOD FOR FABRICATING COMPOSITE LAMINATE STRUCTURES WITH CO-LAMINATED RADAR ABSORBING MATERIAL

TECHNICAL FIELD

The disclosed subject matter relates to the field of composite laminates and radar absorbing materials, and more particularly to systems and methods for fabricating composite laminate structures with co-laminated radar absorbing material.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright 2007-2008 Composite Engineering, Inc. (CEI), All Rights Reserved.

BACKGROUND

Advanced composites of layers of polymer or resin-impregnated fibers are commonly used as a primary structural component in the manufacture of a variety of structures, including airframe components for various types of aircraft. These materials provide greater structural efficiency at lower weights than equivalent metallic structures. Other uses for composite laminates include marine craft, submersibles, land vehicles, stationary structures, and many other applications in mobile or stationary structures or components.

One particular application for which composite laminates are used is the fabrication of airframe components for pilotless aircraft, including pilotless target aircraft or drones, which are often used for the training of military pilots. Given that drones are subject to damage or destruction when used for their intended purpose, it is important to develop manufacturing techniques that can produce drone aircraft as inexpensively as possible. For this reason, composites have become a popular choice for drone airframe fabrication. In support of low cost manufacture, it is also important to reduce the need for manual steps in the assembly of the finished airframe. Manual steps are labor-intensive, expensive, and can lead to finished products that are not uniform.

Drones used for military training are often required to model the physical, visual, thermal, and electromagnetic characteristics of the hostile aircraft against which pilots are being trained. For this reason, drones must be manufactured to specific specifications as mandated by a government agency or civilian organization. One of these specifications defines a particular radar signature that a drone must present in flight. To meet radar signature specifications, drone manufacturers can design a drone to be of a particular size and shape. Additionally, the drone can be constructed with radar absorbing material (RAM) covering all or a portion of the exterior of the airframe. The use of RAM enables a drone manufacturer to precisely configure a drone with a desired level of radar reflectivity. The purpose of this material is to absorb radio frequency radiation (e.g. microwave or radar) to prevent reflection. Some form of RAM is commonly used on military aircraft, ships, land vehicles, and fixed installations.

Many types of radar absorbing materials are known in the art. For example, the U.S. Patents referenced below describe a few RAM compounds that can be used for configuring an object with a desired radar signature. In other implementations, RAM is made from a non-electrically conductive (dielectric) polymer with dispersed particles of conductive and/or magnetic particles (typically a form of Iron). Traditionally, this material is made from a cured elastomeric (rubber-like) material with an adhesive backing to allow installation on the structure that requires this treatment.

Unfortunately, these conventional RAM compounds/materials and associated manufacturing techniques are problematic for several reasons. Using one conventional technique, RAM is sprayed or painted on the exterior of an airframe. However, this technique can only produce a thin layer of RAM on the airframe. If applied too thickly, the RAM is subject to cracking or flaking due to vibration and high airflow in flight. Unfortunately, a thin layer of RAM often cannot produce a desired level of radar absorption.

Using another conventional technique, RAM is manually applied to the exterior of an airframe in strips or pieces cut from a sheet of RAM. The RAM pieces are typically glued, stapled, or riveted to the airframe. Although this technique can achieve a desired thickness and arrangement of RAM on an airframe, the seams or joins between RAM pieces can peel up, form gaps, or perturb the smooth flow of air across the airframe. Further, this technique does not produce a finished product on which the RAM is tightly and uniformly contoured to the mold shape. The finished structure with a RAM layer applied using conventional techniques is not sufficiently durable as the glued-on RAM can create a path for water, air, or other matter that may cause separation of the RAM from the outer surface of the structure. In addition, this technique for applying RAM is labor-intensive and time-consuming.

Using still another conventional technique, RAM is integrated into a formulation of composite material from which a composite laminate airframe is fabricated. This technique avoids the problems associated with sprayed-on or glued-on RAM. However, it is sometimes difficult to achieve a desired level of radar absorption with composite-integrated RAM. Further, it is not possible to cover only a portion of the airframe using this technique. Finally, the integrated RAM can interfere with the structural integrity of the composite airframe.

U.S. Pat. No. 6,486,822 describes coated ferromagnetic particles, which are useful as radar absorbing material (RAM). In particular, ferromagnetic particles such as iron, carbonyl iron, cobalt, nickel, and alloys thereof are provided that have been coated with a protective non-conducting material such as silicon, silicon dioxide, aluminum oxide, and the like. The ferromagnetic particles are coated in a rotating retort containing a gaseous composition that deposits onto or diffuses into the particle. The coated particles are particularly suitable for incorporation into RAM coating compositions intended for use in corrosive atmospheres.

U.S. Pat. No. 5,552,455 describes a radar absorbing material and a process for making same. In detail, the technique includes a binder material containing a mixture of two groups of spheres made of a magnetic material, The first group of spheres have an average diameter and the second group have an average diameter generally 0.73 times the average diameter of the spheres of the first group. The first and second group contains generally equal numbers of spheres. The amount of the binder material incorporated is sufficient to both bind mixture together while maintaining the individual spheres separated from each other.

U.S. Pat. No. 6,411,248 describes a glue-gun applied hot-melt radar-absorbing material (RAM) and method. The hot-melt radar-absorbing material composition comprises: (a) 70 to 85 wt % carbonyl iron powder; (b) 2 to 10 wt % of a metal deactivator; and (c) balance a thermoplastic polyurethane. The method for repair of a body with a radar-absorbing material, comprises: (a) formulating the hot-melt radar-absorbing material of the present invention; (b) forming the hot-melt radar-absorbing material into a shape; (c) applying the hot-melt radar-absorbing material in a molten state onto the body; and (d) allowing the hot-melt radar-absorbing material to cool to room temperature. The shape of the hot-melt RAM is advantageously a "glue stick", which is configured to go into a glue gun. The repair operator loads the glue stick into the glue gun and pulls the trigger. The glue gun heats the glue stick, and the molten material is applied to the area to be repaired.

U.S. Pat. No. 6,111,534 describes a structural composite material able to absorb radar waves at frequencies of 18 GHz, 35 GHz and 94 GHz. This material comprises at least three layers of non-magnetic, dielectric material obtained by stacks of impregnated plies, including an outer layer with a low reflection index and losses having an effective dielectric permittivity of around 3, to promote the penetration of the incident radar waves, an intermediate layer having an effective dielectric permittivity of around 5, and an inner layer loaded with electrically conductive particles and having a substantial effective dielectric permittivity of around 15 to 20. The material may have applications in the manufacture of chests for military vehicles, for example.

U.S. Pat. No. 7,112,299 describes a method of fabricating laminate articles. A plurality of support templates are arranged to define a part outline corresponding to the laminate article. An outer surface of a primary panel to is secured to the plurality of templates. A secondary panel is arranged in a desired relationship with the primary panel. A vacuum bag is secured to the primary panel to define a vacuum chamber. A vacuum is applied to the vacuum chamber to remove air from between the at least one primary panel and the at least one secondary panel. Optionally, at least one locater peg may be secured to the primary panel and at least one locater hole may be formed in the secondary panel. In this case, the secondary panel is displaced relative to the primary panel such that the at least one locater peg enters the at least one locater hole.

Thus, systems and methods for fabricating composite laminate structures with co-laminated radar absorbing material are needed.

BRIEF DESCRIPTION OF THE DRAWINGS

Embodiments illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there are systems and methods described for fabricating composite laminate structures with co-laminated radar absorbing material (RAM). A particular embodiment relates to a system and process for fabricating airframe components with co-laminated RAM. Various particular example embodiments are described in more detail below.

Figure 1:
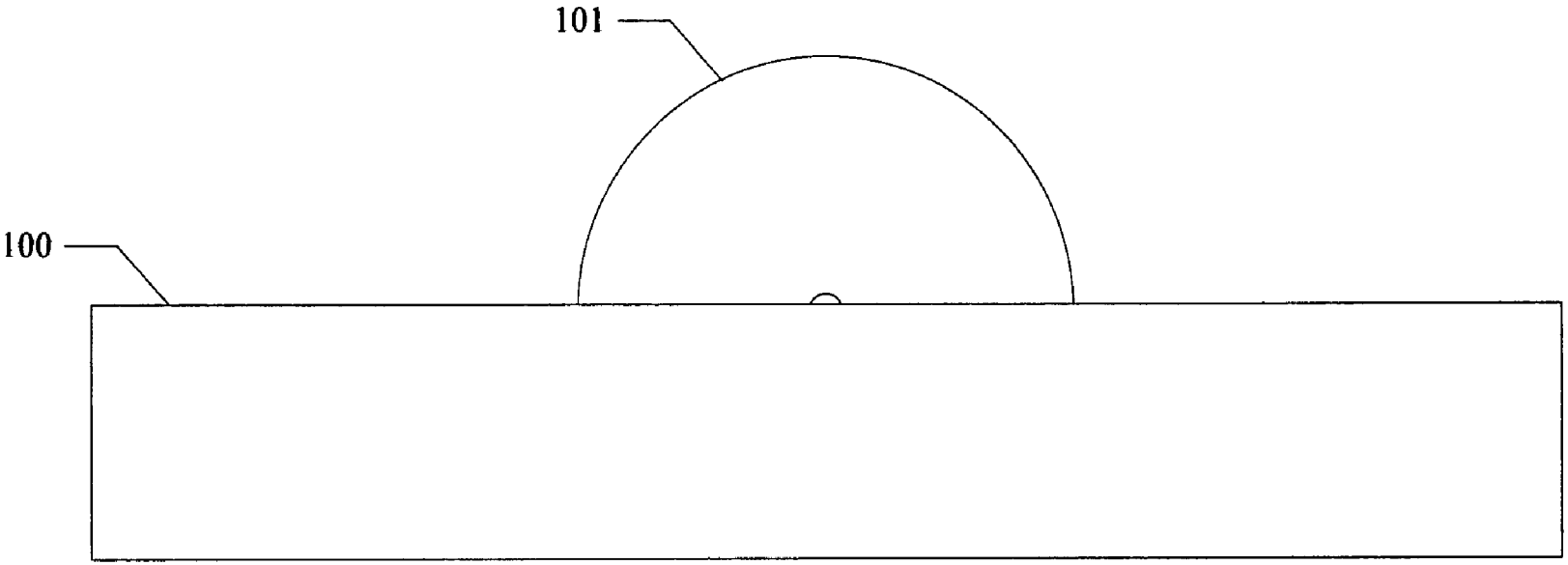
Figure 1 Prior Art
FIG. 1 illustrates an example of a tooling frame for supporting a template arranged to define a part outline corresponding to a laminate article.
Figure 2:
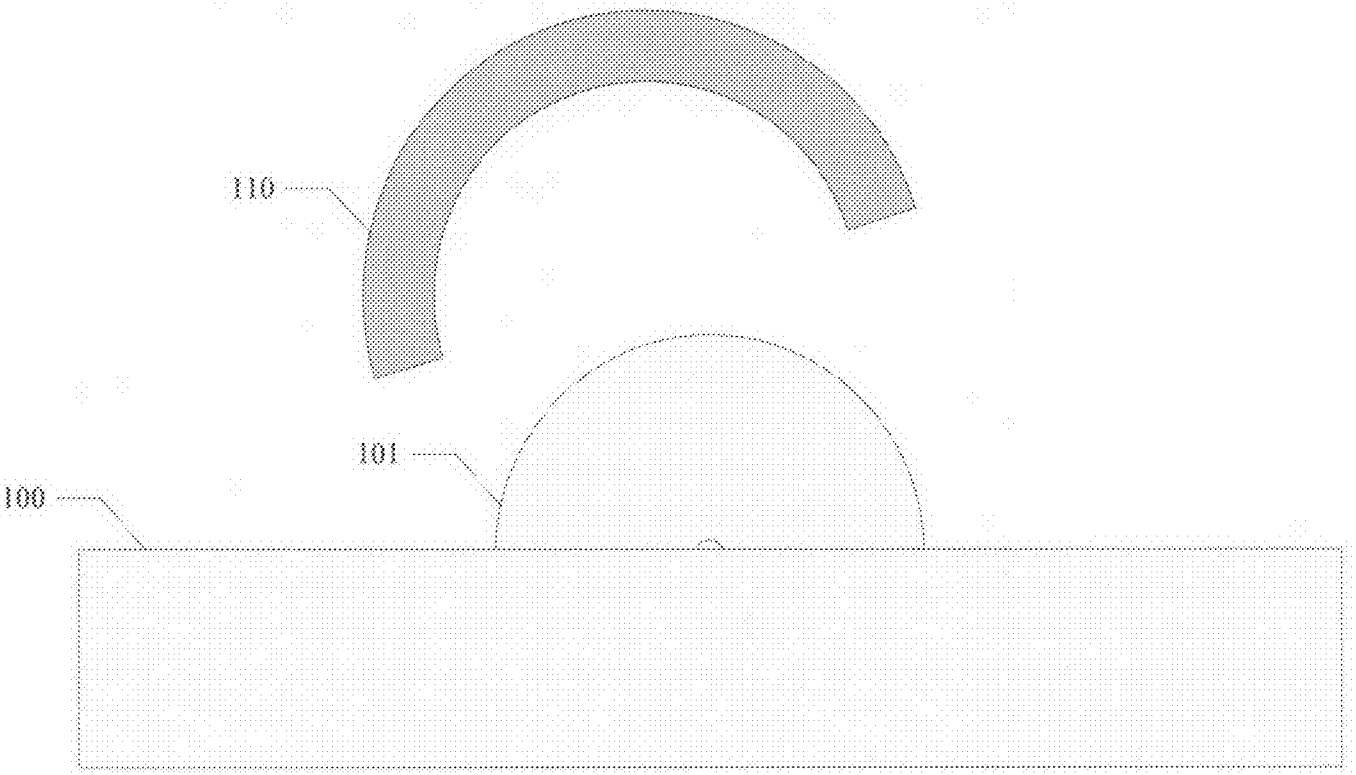
Figure 2 Prior Art
FIG. 2 illustrates an example of an uncured laminate article being placed upon the upper surface of the template.
Figure 3:
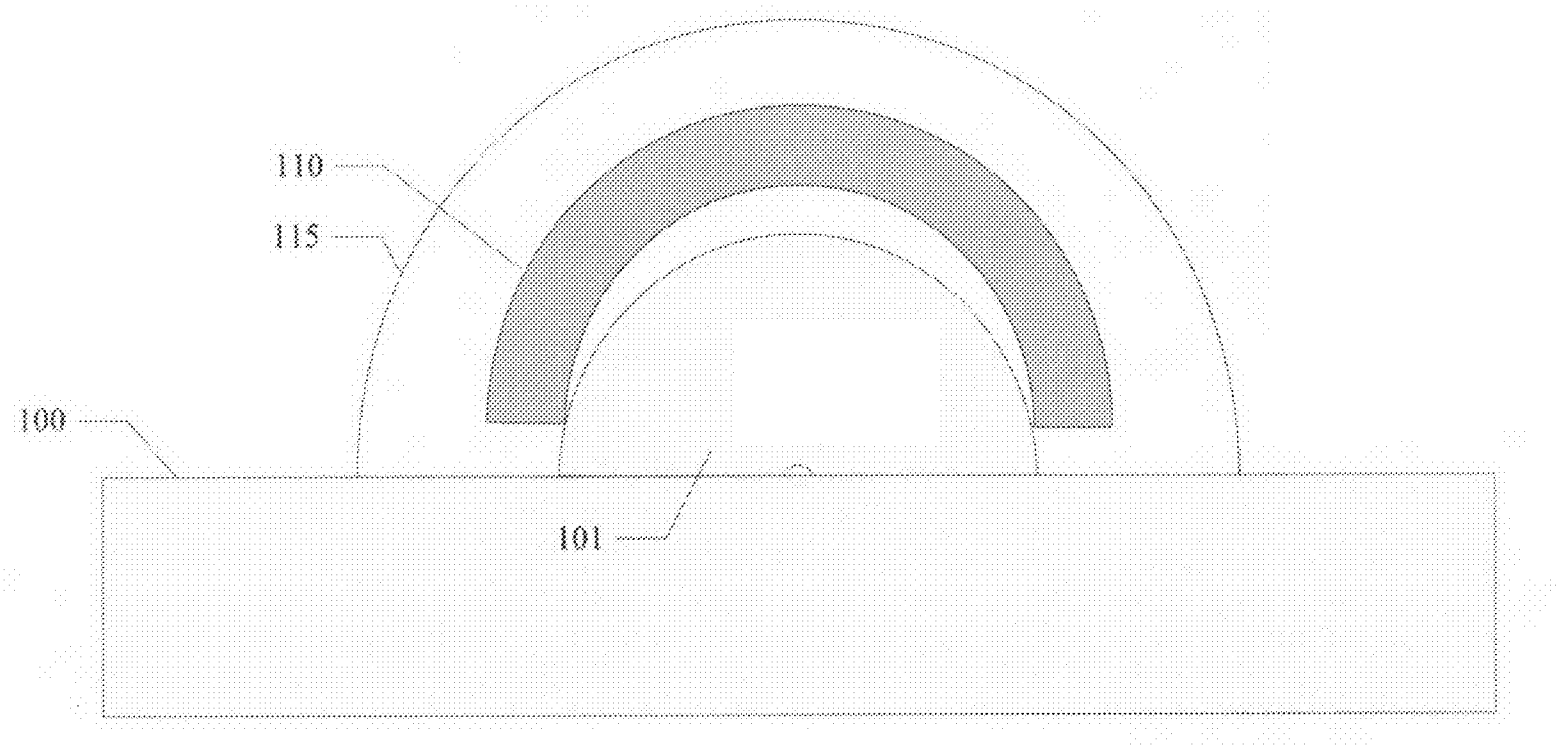
Figure 3 Prior Art
FIG. 3 illustrates an example of a vacuum bag being secured to the tooling frame.
Figure 4:
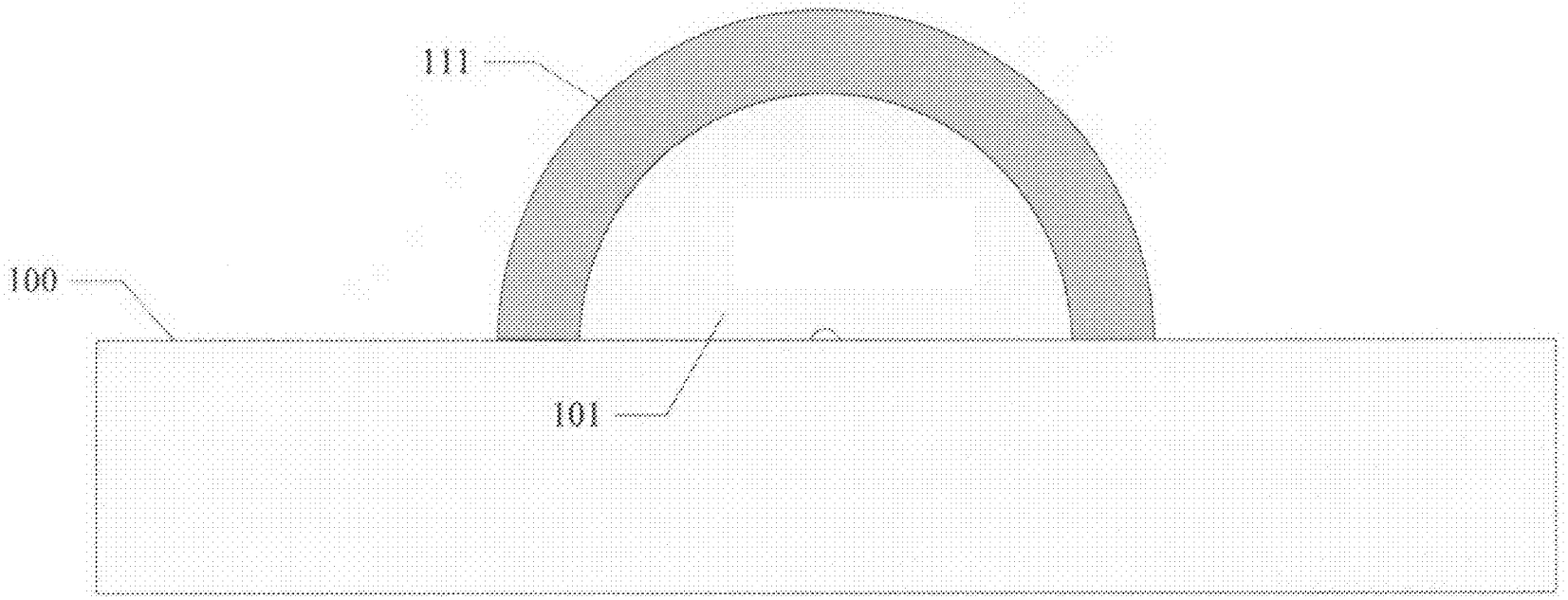
Figure 4 Prior Art
FIG. 4 illustrates an example of a cured laminate article that has conformed to the shape of the template.

FIG. 1 illustrates an example of a tooling frame 100 for supporting a template 101 arranged to define a part outline corresponding to a laminate article. An outer surface of an uncured laminate article 110, as shown in FIG. 2 can be secured to or placed upon the upper surface of the template 101. The uncured laminate article 110 can be conformed to the shape of the template 101 to ultimately produce a cured laminate article in a desired shape. It will be apparent to those of ordinary skill in the art that template 101 can be cut in any desired shape. The shape of template 101 shown in FIGS. 1-7 is merely an example shown for illustrative purposes. Once the uncured laminate article 110, as shown in FIG. 3, is installed upon, secured to, or placed upon the upper surface of the template 101, a vacuum bag 115 can be secured to the tooling frame 100 to enclose the uncured laminate article 110 and template 101 in a vacuum chamber. A vacuum can be applied to the vacuum chamber to remove air from between the vacuum bag 115 and the uncured laminate article 110 and from between the uncured laminate article 110 and the template 101. The removal of air from the vacuum bag 115 causes the vacuum bag 115 to apply a uniform pressure to the inner/ upper surface of the uncured laminate article 110 and forcing the uncured laminate article 110 to conform to the shape of the template 101. The uncured laminate article 110 can be allowed to cure and the vacuum bag 115 can thereafter be removed. The resulting assembly is shown in FIG. 4. As illustrated in FIG. 4, the cured laminate article 111 has conformed to the shape of the template 101. The completed laminate article 111 can be removed from the template 101.

Figure 5:
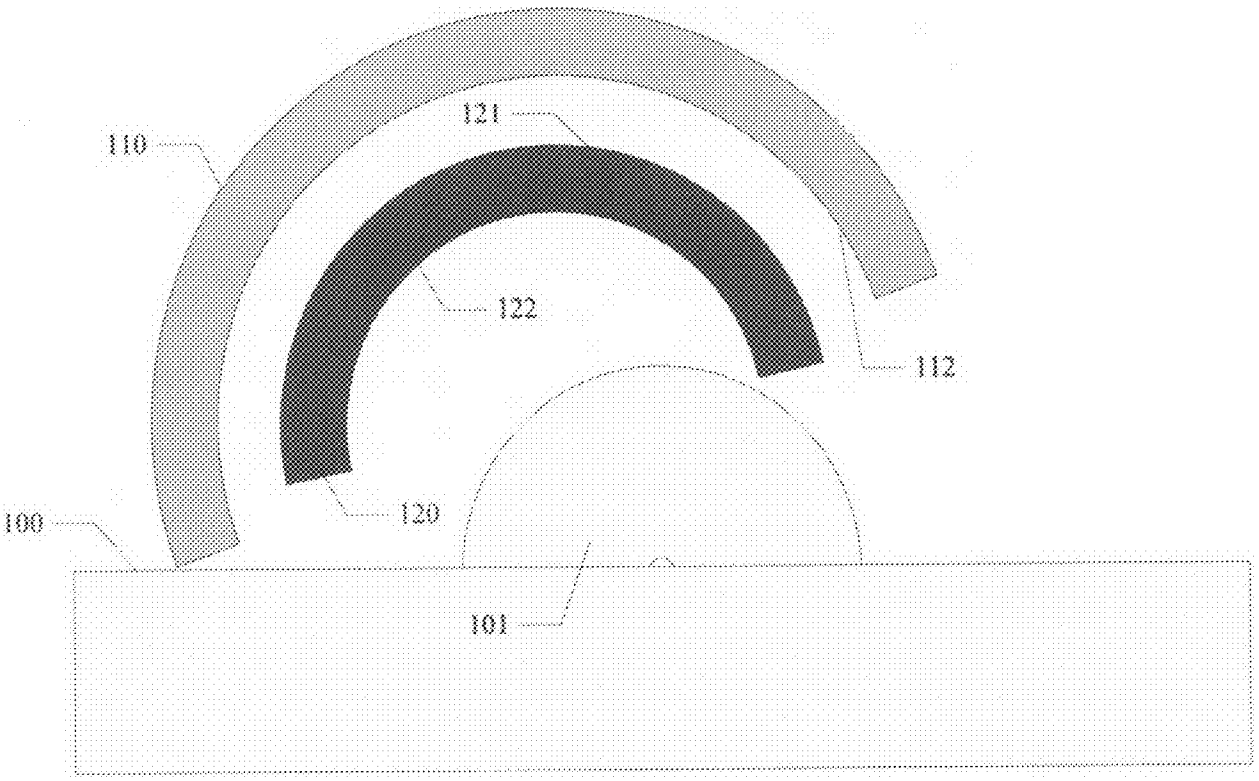
FIG. 5 illustrates an example embodiment in which an uncured laminate article and a layer of radar absorbing material (RAM) is positioned on a template on a tooling frame.
Figure 6:
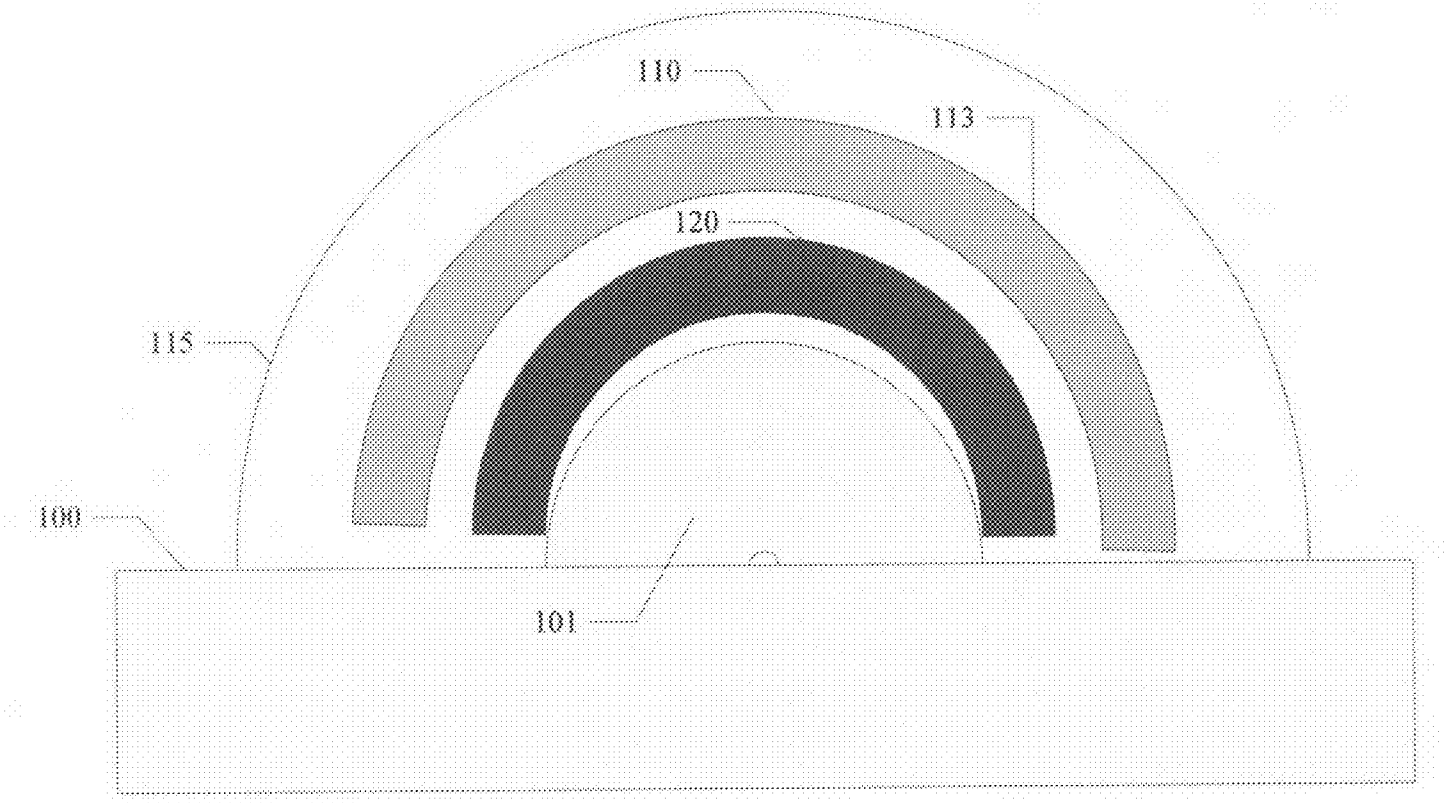
FIG. 6 illustrates an example embodiment in which a vacuum bag can be secured to the tooling frame to enclose the uncured laminate article, the RAM layer, and template in a vacuum chamber.
Figure 7:
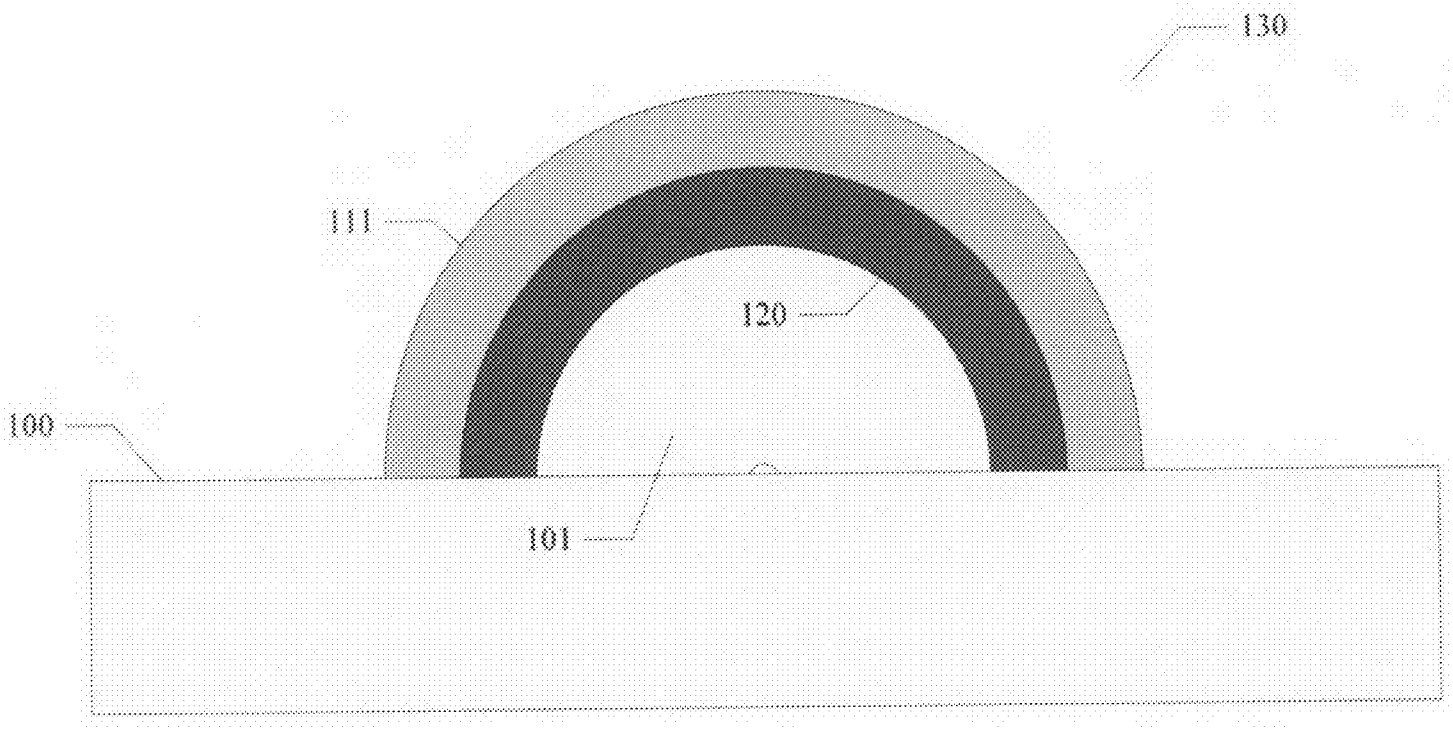
FIGS. 7-8 illustrate an example embodiment in which the resulting example composite laminate structure with co-laminated radar absorbing material is shown.
Figure 8:
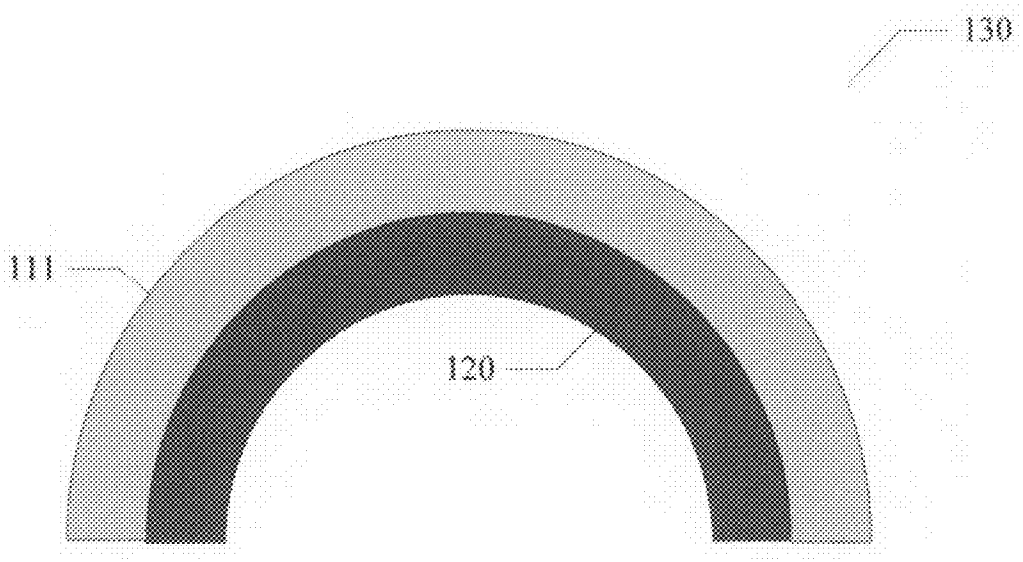

Referring now to FIG. 5, an example illustrates an embodiment of the present invention. In the example shown, an uncured laminate article 110 and a tooling frame 100 with a template 101 is provided. Additionally, a layer of radar absorbing material (RAM) 120 is also provided. As described above, the RAM layer 120 can be one of the many types of radar absorbing materials known in the art. For example, several types of RAM compounds can be used for configuring an object with a desired radar signature. In some implementations, RAM layer 120 is made from a non-electrically conductive (dielectric) polymer with dispersed particles of conductive and/or magnetic particles (typically a form of Iron). RAM layer 120 can also be made from a cured elastomeric (rubber-like) material with an adhesive backing to allow installation of RAM layer 120 on a surface of the structure that requires this treatment. In this case as shown in FIG. 5, RAM layer 120 is interposed between the outer/lower surface 112 of uncured laminate article 110 and the upper surface of template 101. In one embodiment, the natural stickiness of the uncured laminate article 110 can be used as an adhesive to bind the RAM layer 120 to the outer/lower surface 112 of uncured laminate article 110. In a second embodiment, a separate adhesive material (e.g. epoxy, acrylic adhesive, or the like) can be applied between the inner/upper surface 121 of RAM layer 120 and the outer/lower surface 112 of uncured laminate article 110 to bind the RAM layer 120 to the uncured laminate article 110 prior to positioning the RAM layer 120 and the uncured laminate article 110 on template 101. In a third embodiment, a layer or film of pressure-sensitive adhesive material (e.g. rubber adhesive or acrylic) can be applied to the inner/upper surface 121 of RAM layer 120 when the RAM layer 120 is manufactured. Then, when the composite laminate structure with co-laminated radar absorbing material is fabricated, the film of pressure-sensitive adhesive material on the inner/upper surface 121 of RAM layer 120 can bind the RAM layer 120 to the outer/lower surface 112 of the uncured laminate article 110 prior to positioning the RAM layer 120 and the uncured laminate article 110 on template 101. FIG. 5 illustrates positioning the RAM layer 120 and the uncured laminate article 110 on template 101. FIG. 6 illustrates the application of a vacuum bag 115 that can be secured to the tooling frame 100 to enclose the uncured laminate article 110, the RAM layer 120, and template 101 in a vacuum chamber. A vacuum can be applied to the vacuum chamber to remove air from between the vacuum bag 115 and the uncured laminate article 110, from between the uncured laminate article 110 and the RAM layer 120, and from between the RAM layer 120 and the template 101. The removal of air from the vacuum bag 115 causes the vacuum bag 115 to apply a uniform pressure to the inner/upper surface 113 of the uncured laminate article 110 and the to the inner/upper surface 121 of RAM layer 120 thereby forcing the uncured laminate article 110 and the RAM layer 120 to conform to the shape of the template 101. The pressure applied by the vacuum bag 115 also serves to force the uncured laminate article 110 against the RAM layer 120 thereby enabling any of the adhesive methods described above to permanently bond the uncured laminate article 110 to the RAM layer 120. The uncured laminate article 110 and separate adhesive, if any, can be allowed to cure and the vacuum bag 115 can thereafter be removed. The resulting example composite laminate structure with co-laminated radar absorbing material 130 is shown in FIG. 7. As illustrated in FIG. 7, the cured laminate article 111 bonded with the RAM layer 120 has conformed to the shape of the template 101. As shown in FIG. 8, the completed composite laminate structure with co-laminated radar absorbing material 130 can be removed from the template 101.

Figure 9:
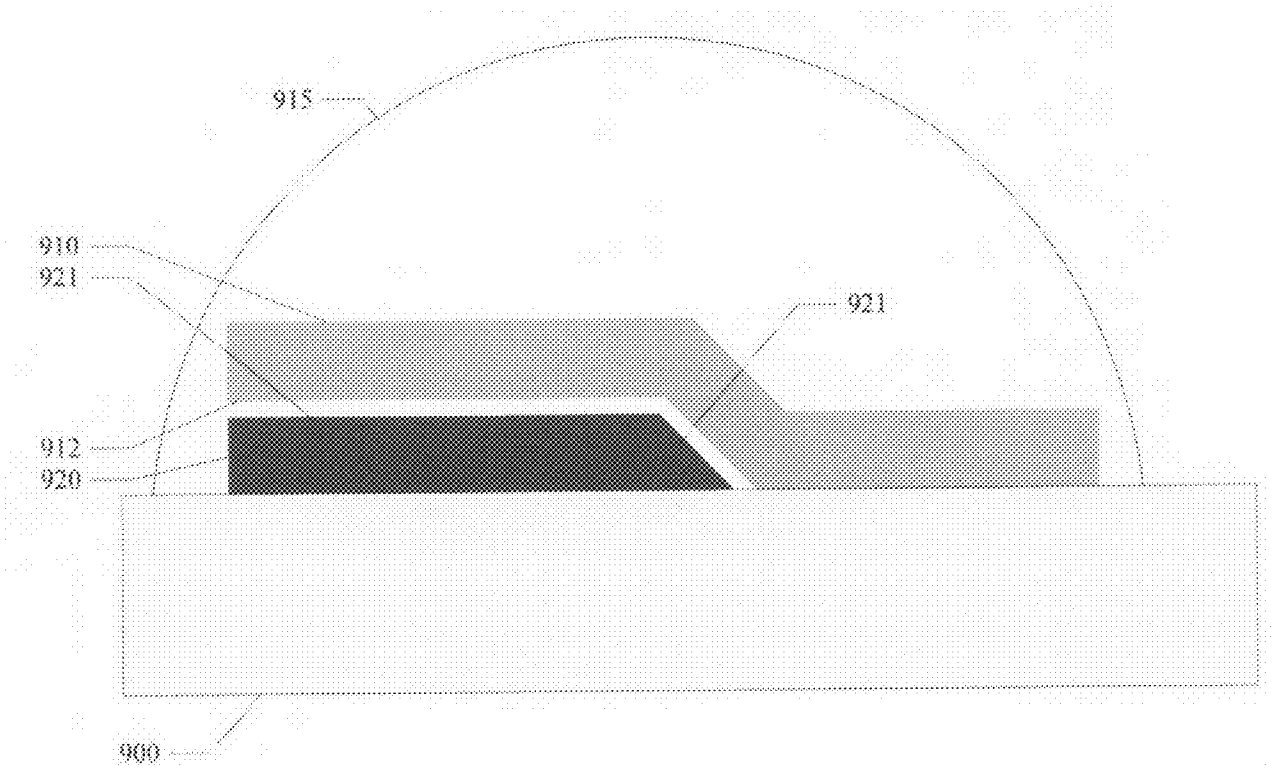
FIGS. 9-14 illustrate other example embodiments of a system and method for fabricating composite laminate structures with co-laminated radar absorbing material in which the uncured laminate article can be set on top of the RAM layer and an edge of the RAM layer can be tapered.

FIG. 9 illustrates another example embodiment of a system and method for fabricating composite laminate structures with co-laminated radar absorbing material. FIG. 9 shows a tooling frame 900 for supporting a laminate article with a RAM layer. An outer/lower surface of the RAM layer 920 can be placed upon the upper surface of the tooling frame 900. An edge 921 of RAM layer 920 can be tapered to create a better seam with the uncured laminate article 910 positioned above the RAM layer 920. The outer/lower surface of the uncured laminate article 910 can be set on top of the inner/upper surface of RAM layer 920. The pliable uncured laminate article 910 will naturally conform to the shape of the RAM layer 920, including the tapered edge 921, as shown in the example of FIG. 9. It will be apparent to those of ordinary skill in the art that RAM layer 920 can be cut in any desired shape.

As shown in FIG. 9, RAM layer 920 is interposed between the outer/lower surface 912 of uncured laminate article 910 and the upper surface of tooling frame 900. In one embodiment, as described above, the natural stickiness of the uncured laminate article 910 can be used as an adhesive to bind the RAM layer 920 to the outer/lower surface 912 of uncured laminate article 910. In a second embodiment, as described above, a separate adhesive material (e.g. epoxy, acrylic adhesive, or the like) can be applied between the inner/upper surface 921 of RAM layer 920 and the outer/lower surface 912 of uncured laminate article 910 to bind the RAM layer 920 to the uncured laminate article 910 prior to positioning the RAM layer 920 and the uncured laminate article 910 on tooling frame 900. In a third embodiment, as described above, a layer or film of pressure-sensitive adhesive material (e.g. rubber adhesive or acrylic) can be applied to the inner/upper surface 921 of RAM layer 920 when the RAM layer 920 is manufactured. Then, when the composite laminate structure with co-laminated radar absorbing material is fabricated, the film of pressure-sensitive adhesive material on the inner/upper surface 921 of RAM layer 920 can bind the RAM layer 920 to the outer/lower surface 912 of the uncured laminate article 910 prior to positioning the RAM layer 920 and the uncured laminate article 910 on tooling frame 900.

Figure 10:
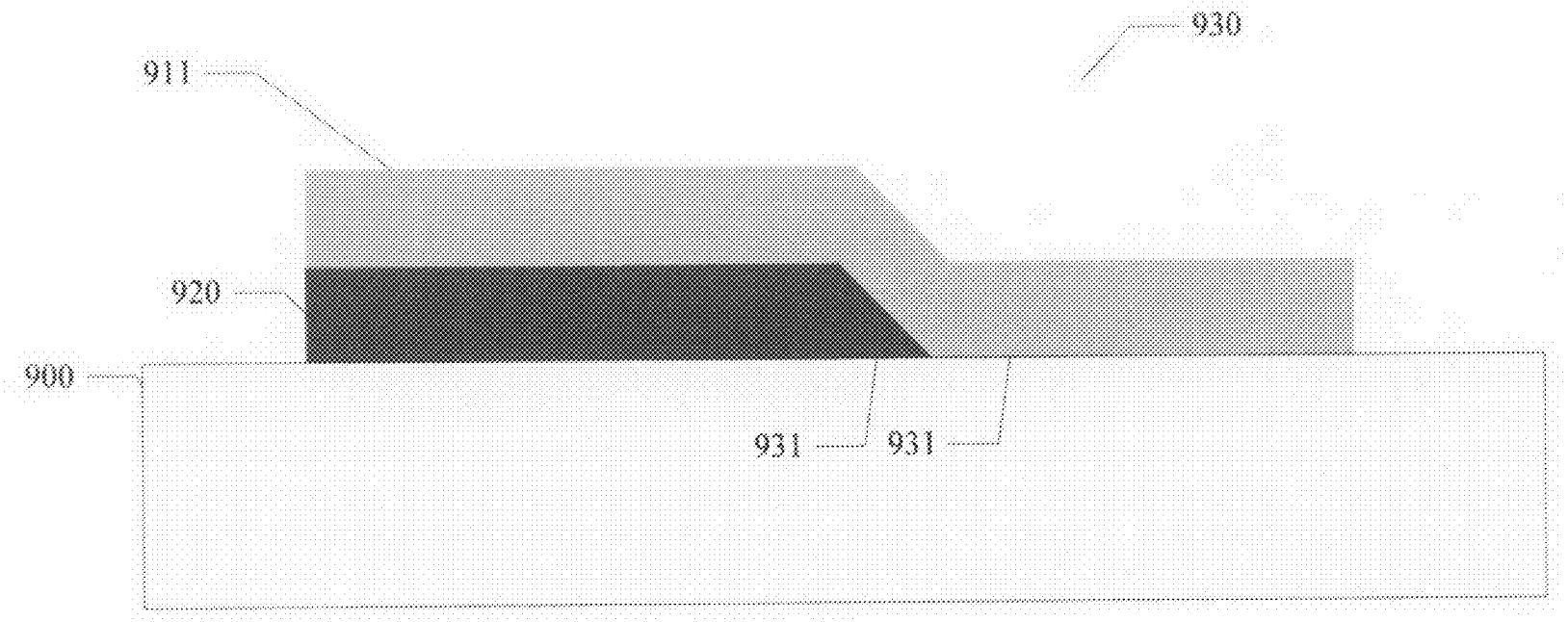
Figure 11:
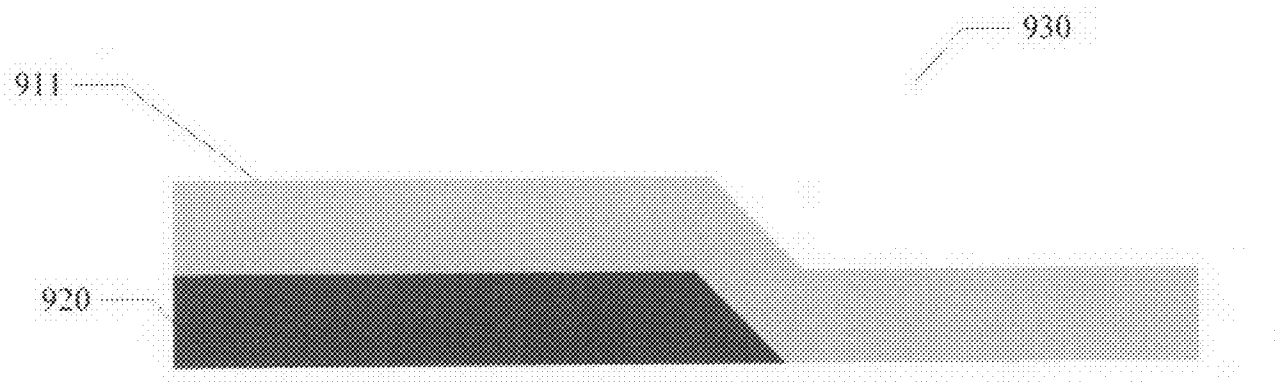

Once the uncured laminate article 910 and RAM layer 920 are positioned on the tooling frame 900 as desired, a vacuum bag 915 can be secured to the tooling frame 900 to enclose the uncured laminate article 910 and the RAM layer 920 in a vacuum chamber. A vacuum can be applied to the vacuum chamber to remove air from between the vacuum bag 915 and the uncured laminate article 910, from between the uncured laminate article 910 and the RAM layer 920, and from between the RAM layer 920 and the tooling frame 900. The removal of air from the vacuum bag 915 causes the vacuum bag 915 to apply a uniform pressure to the inner/upper surface of the uncured laminate article 910 thereby forcing the uncured laminate article 910 to conform to the shape of the RAM layer 920. The pressure applied by the vacuum bag 915 also serves to force the uncured laminate article 910 against the RAM layer 920 thereby enabling any of the adhesive methods described above to permanently bond the uncured laminate article 910 to the RAM layer 920. The uncured laminate article 910 and separate adhesive, if any, can be allowed to cure and the vacuum bag 915 can thereafter be removed. The resulting example composite laminate structure with co-laminated radar absorbing material 930 is shown in FIG. 10. As illustrated in FIG. 10, the cured laminate article 911 bonded with the RAM layer 920 has conformed to the shape of the RAM layer 920 and created a straight and smooth outside surface 931 of the composite laminate structure with co-laminated radar absorbing material 930. As shown in FIG. 11, the completed composite laminate structure with co-laminated radar absorbing material 930 can be removed from the tooling frame 900.

Figure 12:
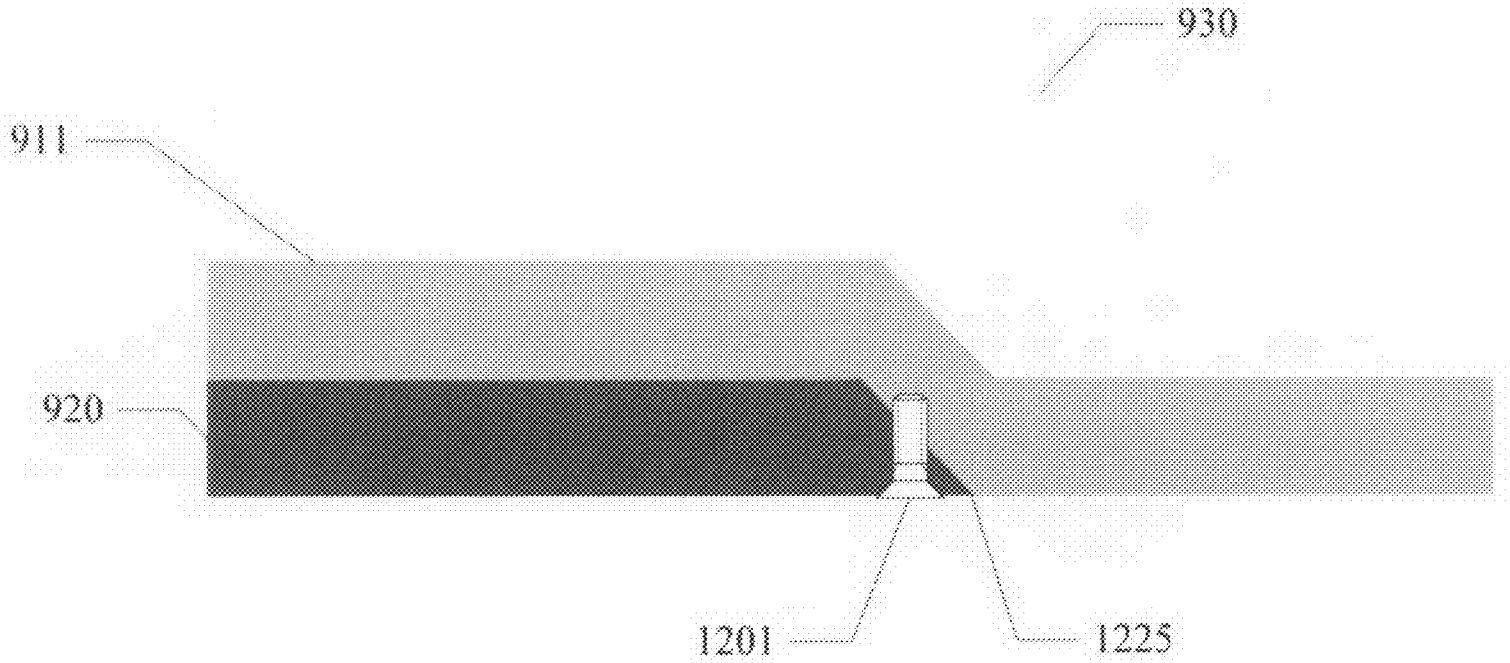

FIG. 12 illustrates a particular embodiment of the completed composite laminate structure with co-laminated radar absorbing material 930 wherein a screw or rivet 1201 has been inserted into the exterior surface of the structure 930 at or adjacent to the seam or joint 1225 between the RAM layer 920 and the composite laminate layer 911 to reinforce the joint and prevent the RAM layer 920 from separating from the composite laminate layer 911.

Figure 13:
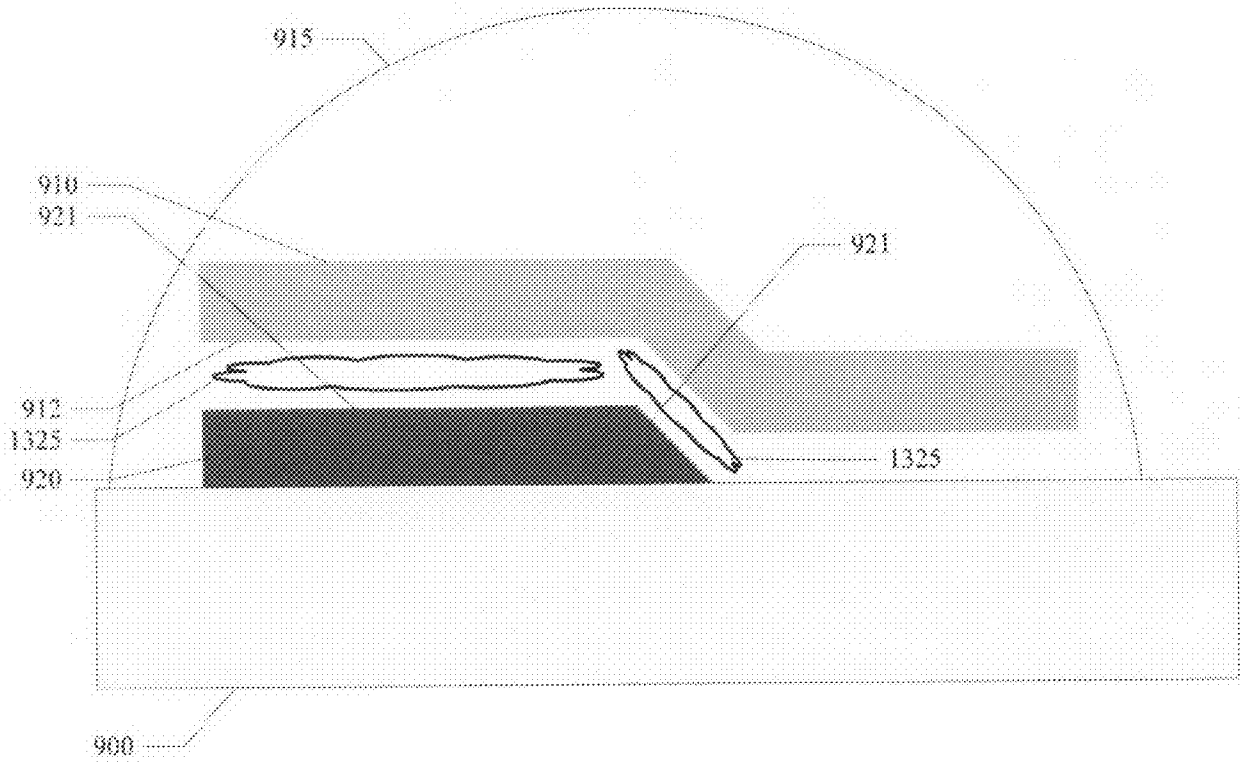

FIG. 13 illustrates a particular embodiment of a system and method for fabricating composite laminate structures with co-laminated radar absorbing material. FIG. 13 shows a tooling frame 900 for supporting a laminate article with a RAM layer. An outer/lower surface of the RAM layer 920 can be placed upon the upper surface of the tooling frame 900. As shown in FIG. 13, RAM layer 920 is interposed between the outer/lower surface 912 of uncured laminate article 910 and the upper surface of tooling frame 900. In the particular embodiment illustrated in FIG. 13, a separate adhesive material (e.g. epoxy, acrylic adhesive, or the like) 1325 can be applied between the inner/upper surface 921 of RAM layer 920 and the outer/lower surface 912 of uncured laminate article 910 to bind the RAM layer 920 to the uncured laminate article 910 prior to or concurrently with positioning the RAM layer 920 and the uncured laminate article 910 on tooling frame 900.

Figure 14:
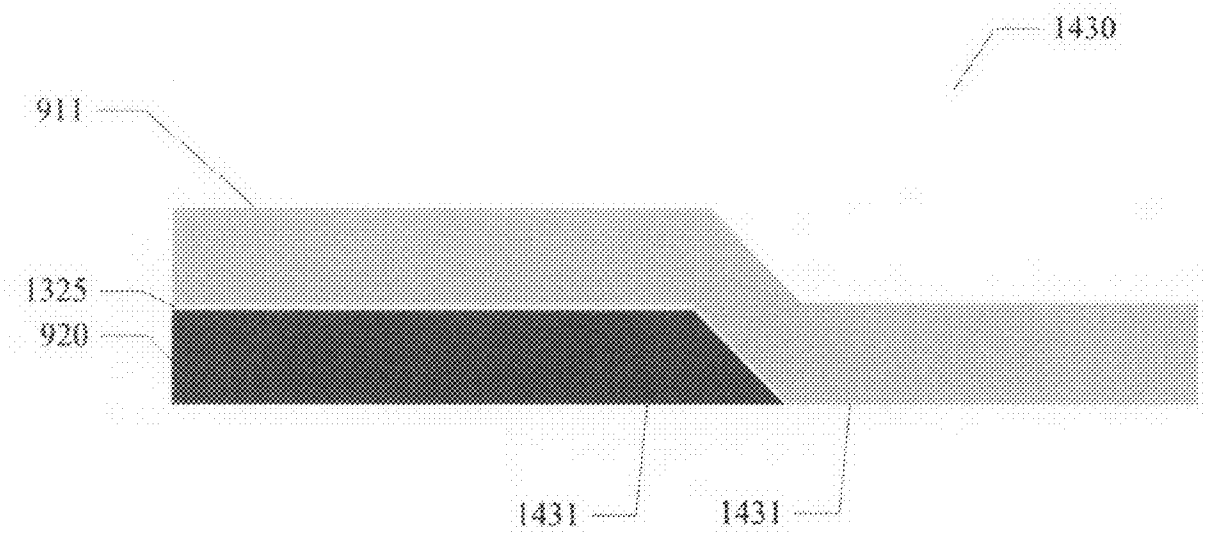

Once the uncured laminate article 910 and RAM layer 920 are bonded with adhesive 1325 and positioned on the tooling frame 900 as desired, a vacuum bag 915 can be secured to the tooling frame 900 to enclose the uncured laminate article 910 and the RAM layer 920 in a vacuum chamber. As described above, a vacuum can be applied to the vacuum chamber to force the uncured laminate article 910 to conform to the shape of the RAM layer 920 and to force the uncured laminate article 910 against the RAM layer 920 thereby enabling adhesive 1325 to permanently bond the uncured laminate article 910 to the RAM layer 920. The uncured laminate article 910 and separate adhesive 1325 can be allowed to cure and the vacuum bag 915 can thereafter be removed. The resulting example composite laminate structure with co-laminated radar absorbing material 1430 is shown in FIG. 14. As illustrated in FIG. 14, the cured laminate article 911 bonded with the RAM layer 920 via adhesive 1325 has conformed to the shape of the RAM layer 920 and created a straight and smooth outside surface 1431 of the composite laminate structure with co-laminated radar absorbing material 1430.

Figure 15:
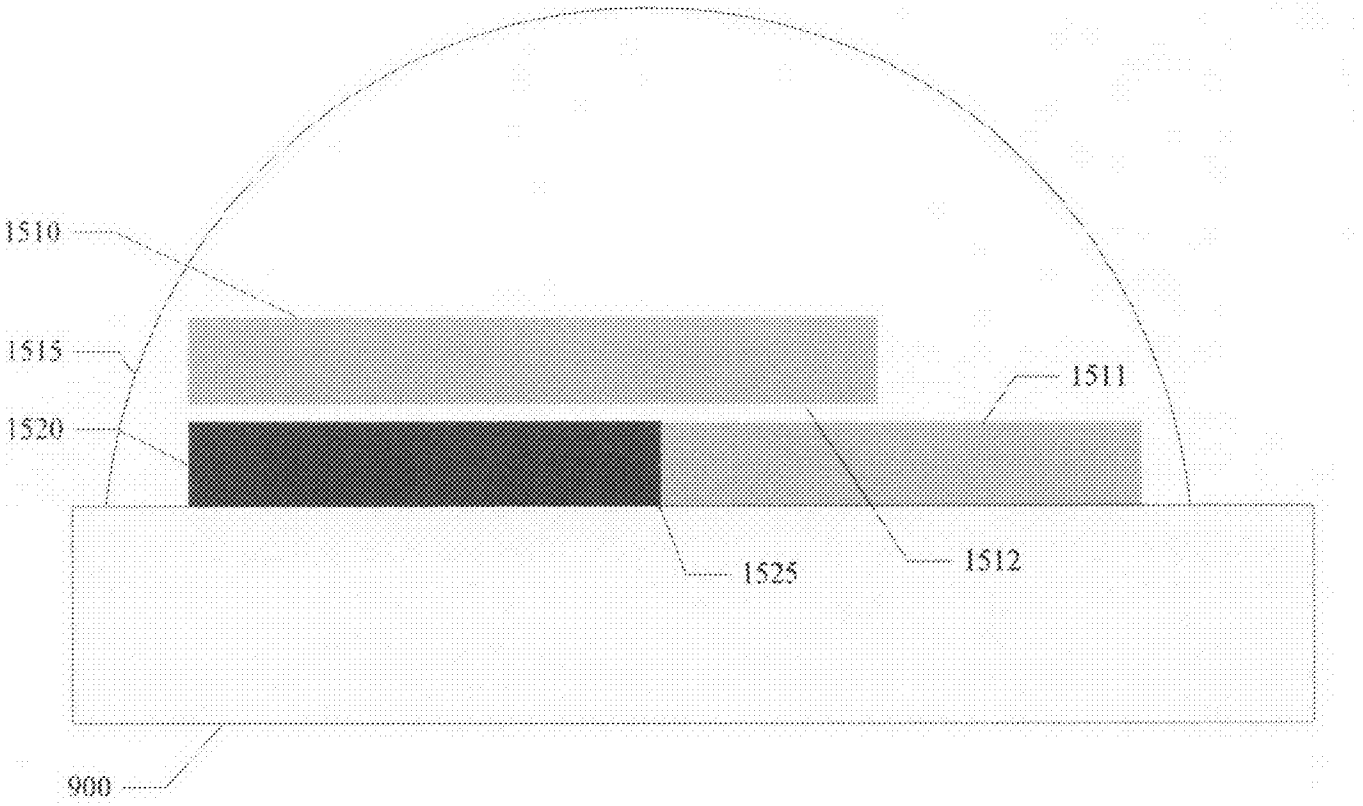
FIGS. 15-19 illustrate other example embodiments of a system and method for fabricating composite laminate structures with co-laminated radar absorbing material in which a first uncured laminate article can be set adjacent to the RAM layer and a second uncured laminate article can be set on top of the first uncured laminate article and the RAM layer and an edge of the RAM layer can be straight or tapered.

FIG. 15 illustrates a particular embodiment of a system and method for fabricating composite laminate structures with co-laminated radar absorbing material. In this example, a first uncured laminate article 1511 is placed on an upper surface of tooling frame 900 adjacent to a RAM layer 1520. The RAM layer 1520 and uncured laminate article 1511 make contact at seam or joint 1525 and can be bonded together at joint 1525 using any of the various adhesive methods described above. Next, a second uncured laminate article 1510 can be placed on an upper/inner surface of both the RAM layer 1520 and the first uncured laminate article 1511 as shown in FIG. 15. The second uncured laminate article 1510 can be placed to cover the joint 1525 and provide sufficient surface area on each side of the joint 1525 to ensure a solid bond to both the RAM layer 1520 and the first uncured laminate article 1511. The lower surface 1512 of the second uncured laminate article 1510 can be bonded to the RAM layer 1520 and the first uncured laminate article 1511 using any of the various adhesive methods described above.

Figure 16:
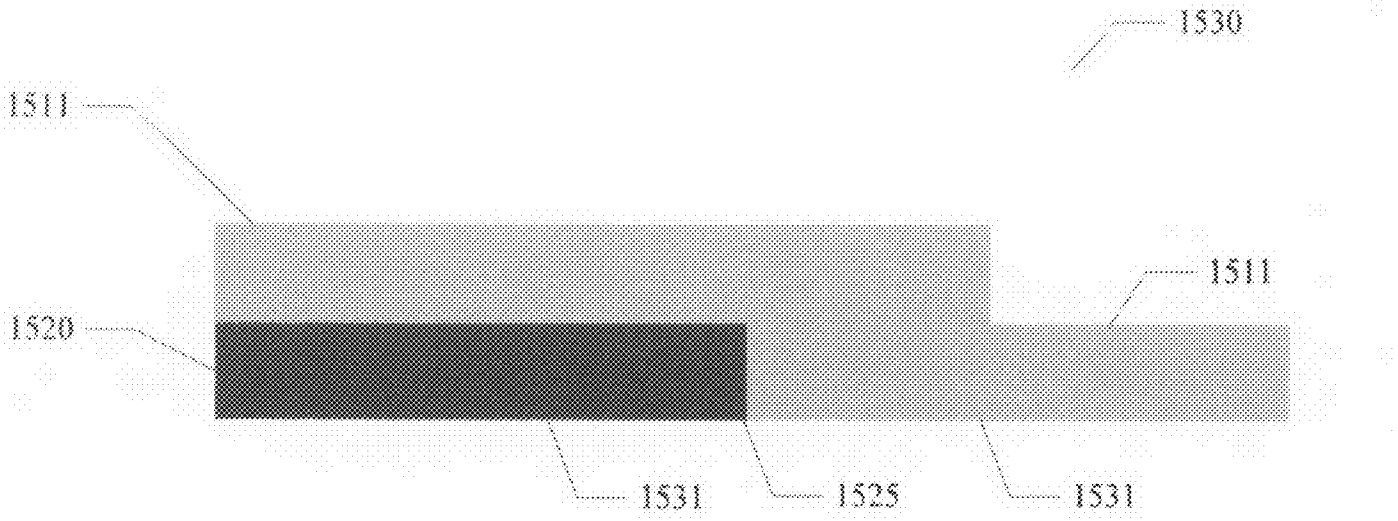

Once the first uncured laminate article 1511, the second uncured laminate article 1510, and the RAM layer 1520 are bonded with adhesive, if any, and positioned on the tooling frame 900 as desired, a vacuum bag 1515 can be secured to the tooling frame 900 to enclose the first uncured laminate article 1511, the second uncured laminate article 1510, and the RAM layer 1520 in a vacuum chamber. As described above, a vacuum can be applied to the vacuum chamber to force the second uncured laminate article 1510 against the RAM layer 1520 and the first uncured laminate article 1511 thereby enabling the second uncured laminate article 1510 to permanently bond to the first uncured laminate article 1511 and the RAM layer 1520. The uncured laminate articles 1510 and 1511 and separate adhesive, if any, can be allowed to cure and the vacuum bag 1515 can thereafter be removed. The resulting example composite laminate structure with co-laminated radar absorbing material 1530 is shown in FIG. 16. As illustrated in FIG. 16, the cured laminate article 1511, bonded with the RAM layer 1520, has conformed to the shape of the RAM layer 1520 and created a straight and smooth outside surface 1531 of the composite laminate structure with co-laminated radar absorbing material 1530. Further, the joint 1525 has been reinforced with the application of the second uncured laminate article 1510.

Figure 17:
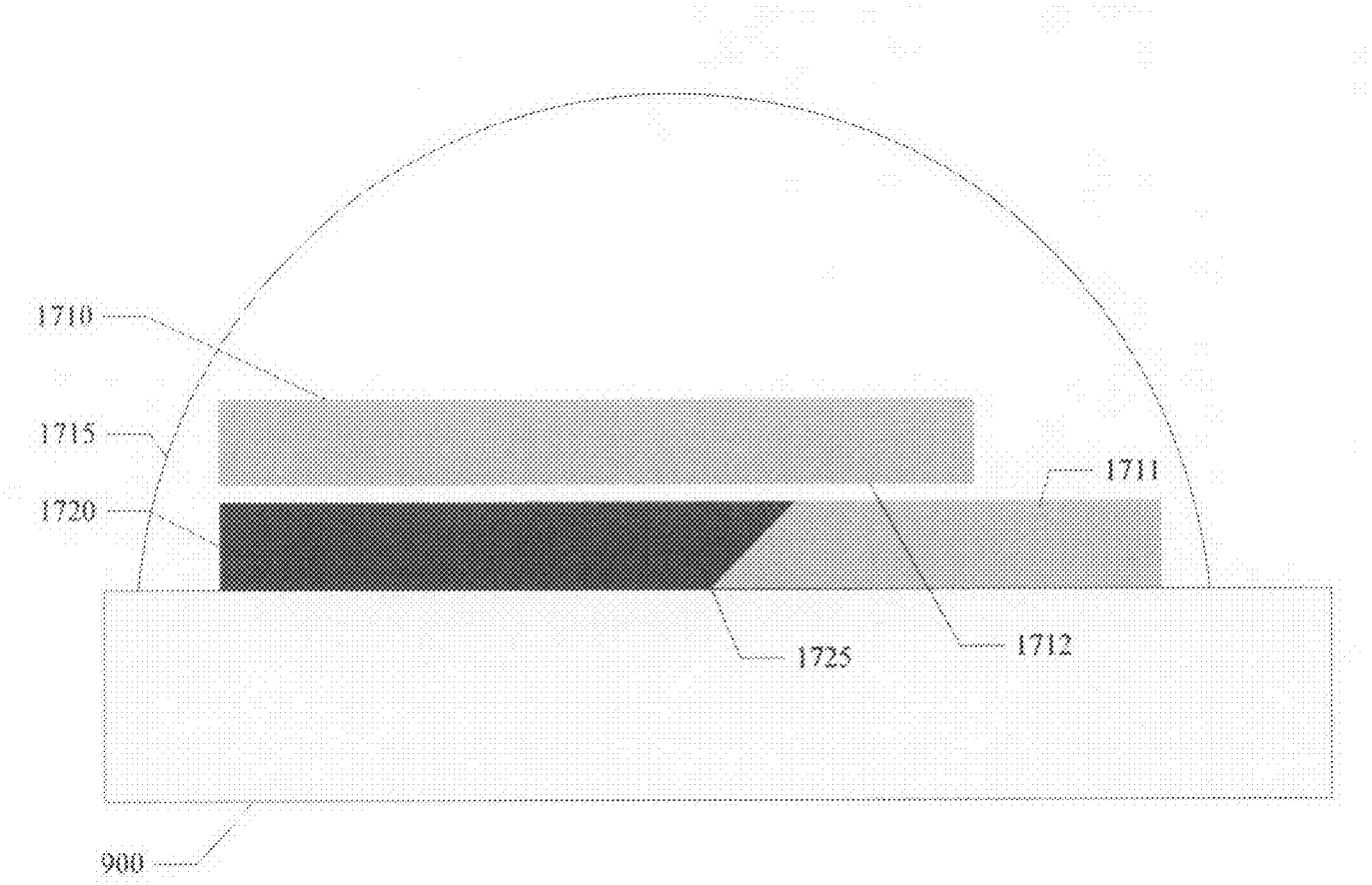

FIG. 17 illustrates a particular embodiment of a system and method for fabricating composite laminate structures with co-laminated radar absorbing material. In this example, a first uncured laminate article 1711 is placed on an upper surface of tooling frame 900 adjacent to a RAM layer 1720. The RAM layer 1720 and uncured laminate article 1711 make contact at seam or joint 1725. In this embodiment, the joint 1725 can be tapered to create a better seam with the first uncured laminate article 1711 positioned adjacent to the RAM layer 1720. The first uncured laminate article 1711 can be bonded to the RAM layer 1720 at joint 1725 using any of the various adhesive methods described above. Next, a second uncured laminate article 1710 can be placed on an upper/inner surface of both the RAM layer 1720 and the first uncured laminate article 1711 as shown in FIG. 17. The second uncured laminate article 1710 can be placed to cover the joint 1725 and provide sufficient surface area on each side of the joint 1725 to ensure a solid bond to both the RAM layer 1720 and the first uncured laminate article 1711. The lower surface 1712 of the second uncured laminate article 1710 can be bonded to the RAM layer 1720 and the first uncured laminate article 1711 using any of the various adhesive methods described above.

Figure 18:
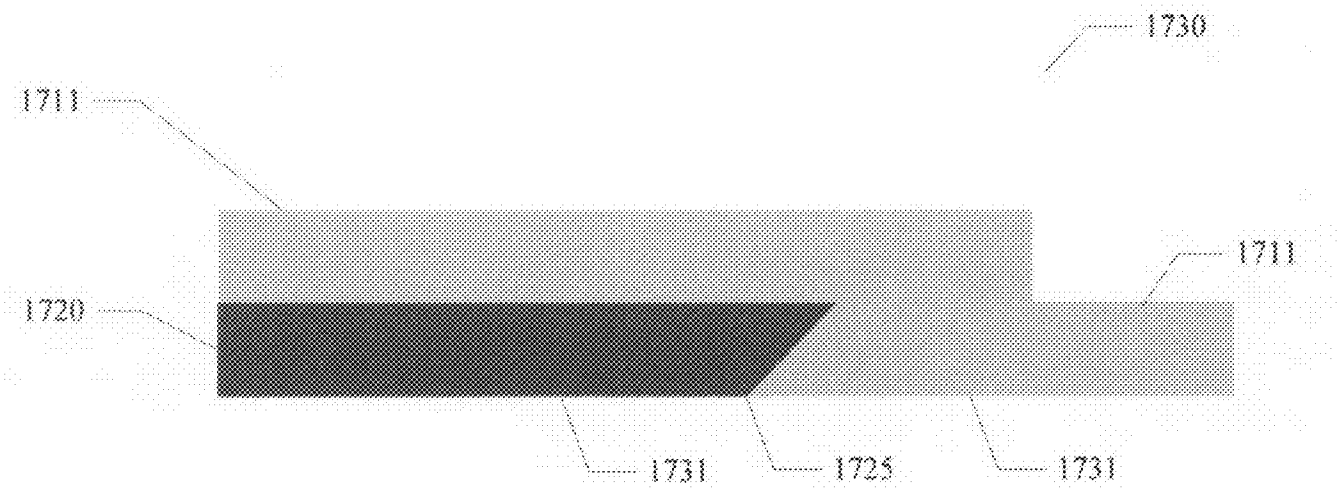

Once the first uncured laminate article 1711, the second uncured laminate article 1710, and the RAM layer 1720 are bonded with adhesive, if any, and positioned on the tooling frame 900 as desired, a vacuum can be applied to force the second uncured laminate article 1710 against the RAM layer 1720 and the first uncured laminate article 1711 thereby enabling the second uncured laminate article 1710 to permanently bond to the first uncured laminate article 1711 and the RAM layer 1720. The uncured laminate articles 1710 and 1711 and separate adhesive, if any, can be allowed to cure. The resulting example composite laminate structure with co-laminated radar absorbing material 1730 is shown in FIG. 18. As illustrated in FIG. 18, the cured laminate article 1711, bonded with the RAM layer 1720, has conformed to the shape of the RAM layer 1720 and created a straight and smooth outside surface 1731 of the composite laminate structure with co-laminated radar absorbing material 1730. Further, the tapered joint 1725 has been reinforced with the application of the second uncured laminate article 1710.

Figure 19:
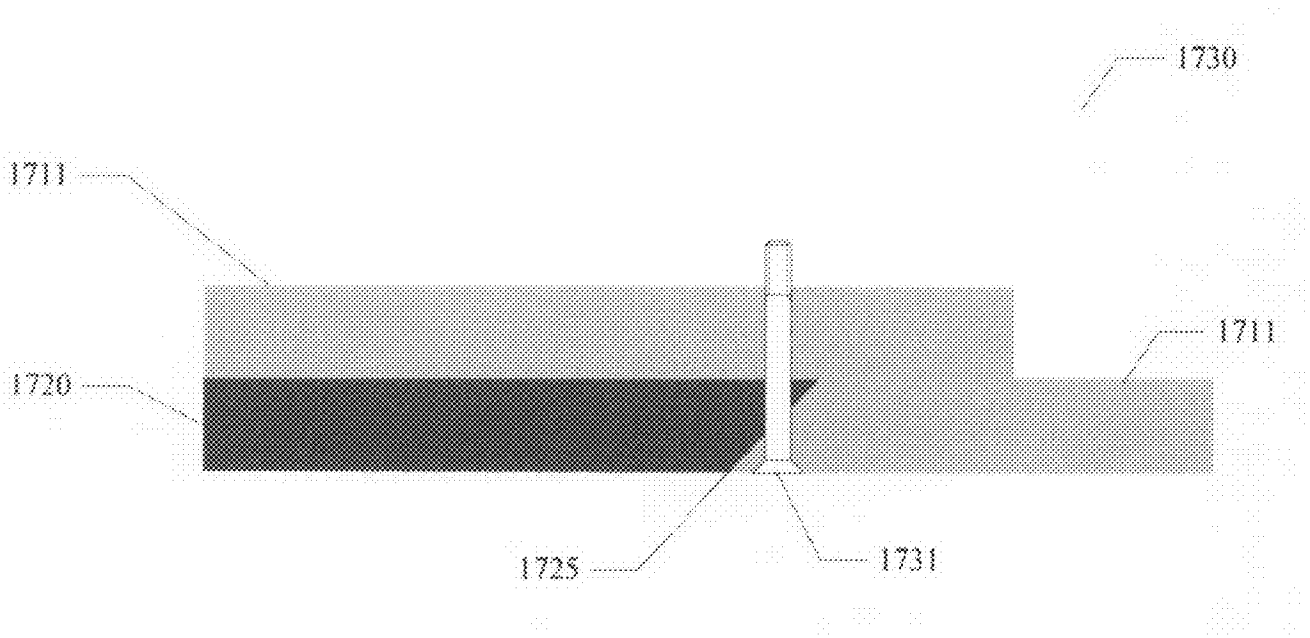

FIG. 19 illustrates a particular embodiment of the completed composite laminate structure with co-laminated radar absorbing material 1730 wherein a screw or rivet 1731 has been inserted into the exterior surface of the structure 1730 at or adjacent to the seam or joint 1725 between the RAM layer 1720 and the composite laminate layer 1711 to reinforce the joint and prevent the RAM layer 1720 from separating from the composite laminate layer 1711.

Figure 20:
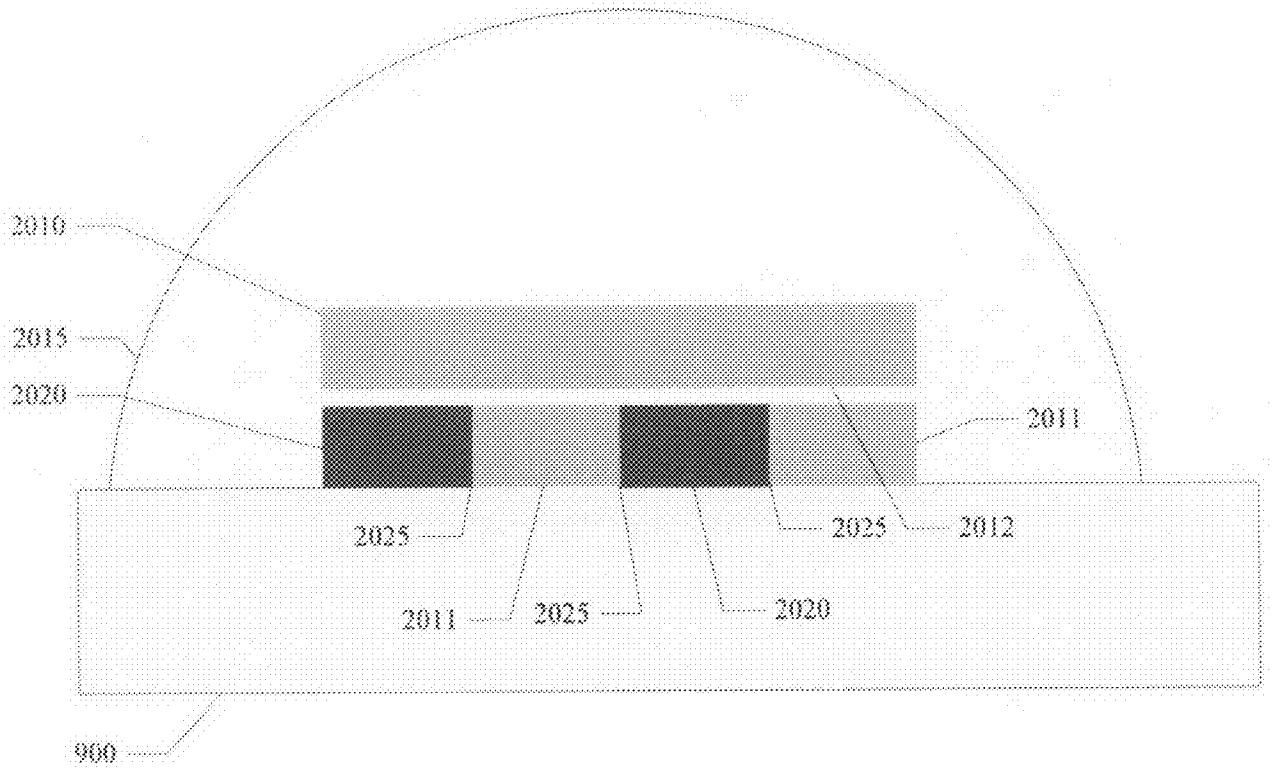
FIGS. 20-21 illustrate other example embodiments of a system and method for fabricating composite laminate structures with co-laminated radar absorbing material in which a plurality of uncured laminate articles can be set adjacent to a plurality of RAM layers and a second uncured laminate article can be set on top of the plurality of uncured laminate articles and the plurality of RAM layers.

FIG. 20 illustrates a particular embodiment of a system and method for fabricating composite laminate structures with co-laminated radar absorbing material. In this example, a plurality of uncured laminate articles 2011 are placed on an upper surface of tooling frame 900 adjacent to a plurality of RAM layers 2020 as shown in FIG. 20. The RAM layers 2020 and uncured laminate articles 2011 make contact at seams or joints 2025. In various embodiments, the joints 2025 can be straight, rounded, or tapered to create better seams between the plurality of uncured laminate articles 2011 and the RAM layers 2020. The plurality of uncured laminate articles 2011 can be bonded to the plurality of RAM layers 2020 at joints 2025 using any of the various adhesive methods described above. Next, a second uncured laminate article 2010 can be placed on upper/inner surfaces of both the plurality of RAM layers 2020 and the plurality of uncured laminate articles 2011 as shown in FIG. 20. The second uncured laminate article 2010 can be placed to cover the joints 2025 and provide sufficient surface area on each side of the joints 2025 to ensure a solid bond to both the plurality of RAM layers 2020 and the plurality of uncured laminate articles 2011. The lower surface 2012 of the second uncured laminate article 2010 can be bonded to the plurality of RAM layers 2020 and the plurality of uncured laminate articles 2011 using any of the various adhesive methods described above.

Figure 21:
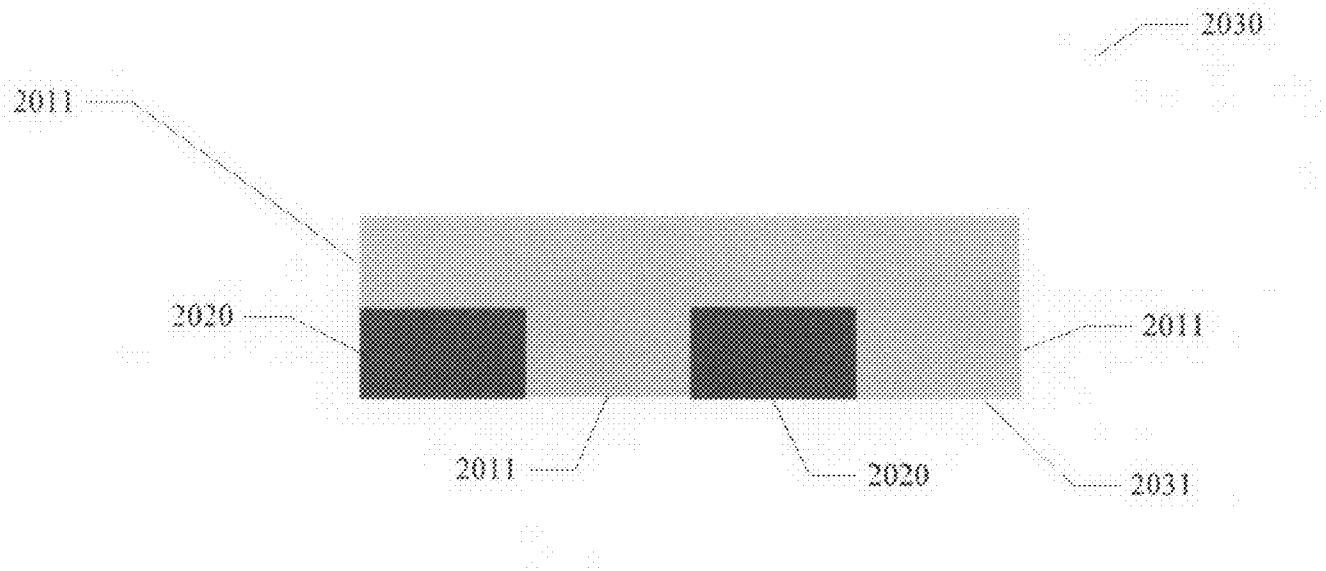

Once the plurality of uncured laminate articles 2011, the second uncured laminate article 2010, and the plurality of RAM layers 2020 are bonded with adhesive, if any, and positioned on the tooling frame 900 as desired, a vacuum can be applied to force the second uncured laminate article 2010 against the plurality of RAM layers 2020 and the plurality of uncured laminate articles 2011 thereby enabling the second uncured laminate article 2010 to permanently bond to the plurality of uncured laminate articles 2011 and the plurality of RAM layers 2020. The uncured laminate articles 2010 and 2011 and separate adhesive, if any, can be allowed to cure. The resulting example composite laminate structure with co-laminated radar absorbing material 2030 is shown in FIG. 21. As illustrated in FIG. 21, the cured laminate article 2011, bonded with the RAM layer 2020, has conformed to the shape of the plurality of RAM layers 2020 and created a straight and smooth outside surface 2031 of the composite laminate structure with co-laminated radar absorbing material 2030. Further, the joints 2025 have been reinforced with the application of the second uncured laminate article 2010. It will be apparent to those of ordinary skill in the art that the dimensions of the plurality of RAM layers 2020 and the plurality of uncured laminate articles 2011 can be varied to expose a desired amount of RAM on the exterior of a particular structure.

Figure 22:
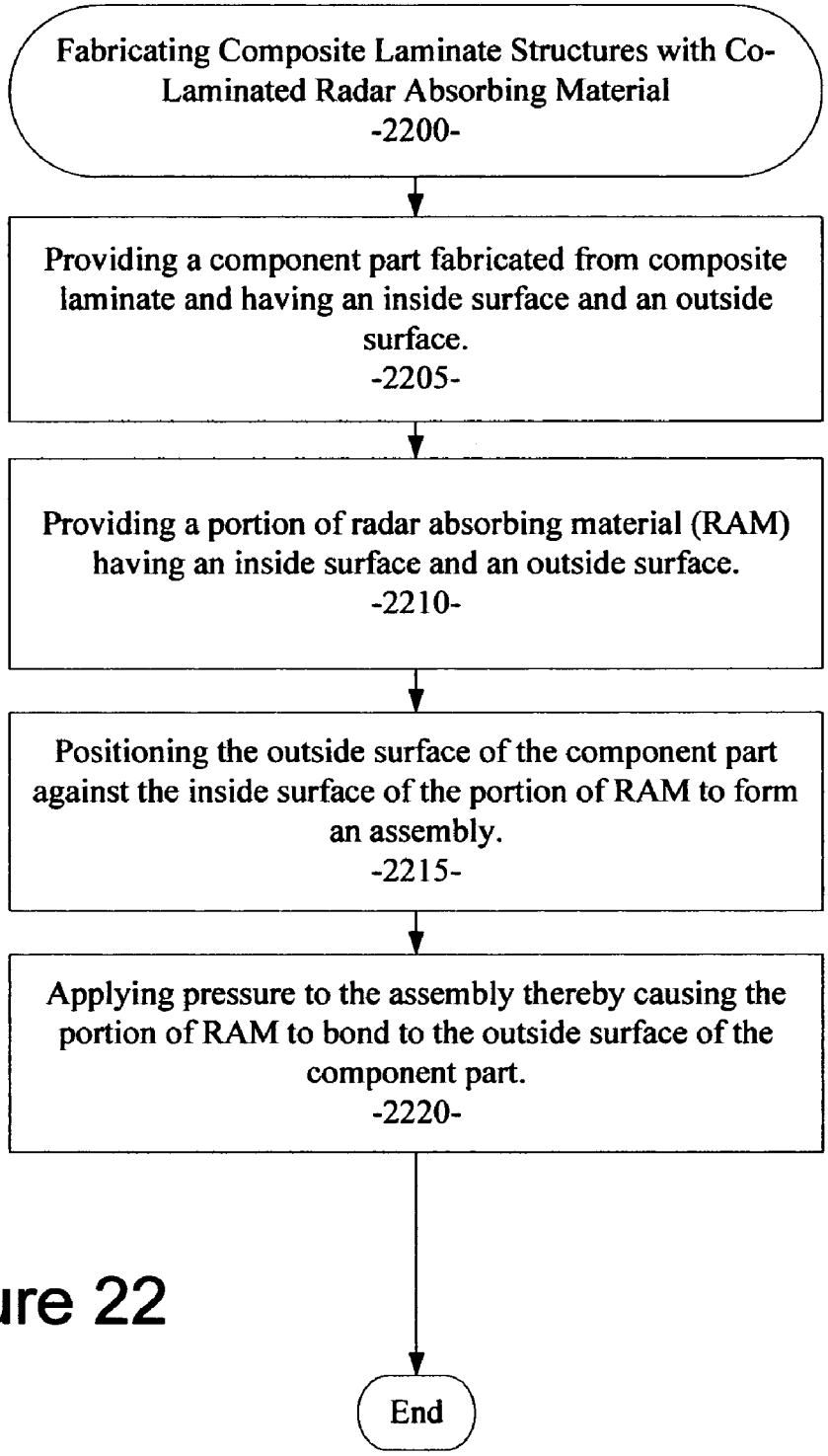
FIG. 22 is a flow diagram illustrating the processing flow for a particular example embodiment.

FIG. 22 is a flow diagram illustrating the processing flow for a particular example embodiment. In the embodiment shown, a method for fabricating composite laminate structures with co-laminated radar absorbing material includes providing a component part fabricated from composite laminate and having an inside surface and an outside surface (processing block 2205); providing a portion of radar absorbing material (RAM) having an inside surface and an outside surface (processing block 2210); positioning the outside surface of the component part against the inside surface of the portion of RAM to form an assembly (processing block 2215); and applying pressure to the assembly thereby causing the portion of RAM to bond to the outside surface of the component part (processing block 2220).

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to comply with 37 C.F.R. §1.74(b) to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus the following claims are hereby incorporated into the Detailed Description, with each claim standing on its own as a separate embodiment.

Thus, as described above, systems and methods for fabricating composite laminate structures with co-laminated radar absorbing material are disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

I claim:

1. A method comprising:

providing a component part fabricated from composite laminate and having an inside surface and an outside surface;

providing a portion of radar absorbing material (RAM) having an inside surface and an outside surface;

positioning the outside surface of the component part against the inside surface of the portion of RAM to form an assembly; and applying pressure to the assembly thereby causing the portion of RAM to bond to the outside surface of the component part.

2. The method as claimed in claim 1 further including applying an adhesive between the portion of RAM and the component part.

3. The method as claimed in claim 1 further including applying an adhesive film to the inside surface of the portion of RAM.

4. The method as claimed in claim 1 wherein the portion of RAM overlaps only a portion of the component part.

5. The method as claimed in claim 1 wherein an edge of the portion of RAM is tapered.

6. The method as claimed in claim 1 wherein the portion of RAM is made from a non-electrically conductive polymer with dispersed particles of conductive particles.

7. The method as claimed in claim 1 wherein the component part is made from composite layers of polymer or resin-impregnated fibers.

8. The method as claimed in claim 1 including applying pressure to the assembly using a vacuum bag.

9. The method as claimed in claim 1 including reinforcing the assembly with a screw or rivet.

10. A method comprising:

providing a first component part fabricated from composite laminate and having an inside surface and an outside surface;

providing a second component part fabricated from composite laminate and having an inside surface and an outside surface, providing a portion of radar absorbing material (RAM) having an inside surface and an outside surface;

positioning the first component part adjacent to the portion of RAM;

positioning the outside surface of the second component part against the inside surface of the portion of RAM and the inside surface of the first component part to form an assembly; and applying pressure to the assembly thereby causing the portion of RAM to bond to the outside surface of the second component part and an edge of the first component part.

11. An apparatus comprising:

a portion of radar absorbing material (RAM) having an inside surface and an outside surface; and a component part fabricated from composite laminate and having an inside surface and an outside surface, the outside surface of the component part being pressure bonded to the inside surface of the portion of RAM to form a composite laminate structure with co-laminated radar absorbing material.

12. The apparatus as claimed in claim 11 including an adhesive for bonding the outside surface of the component part to the inside surface of the portion of RAM.

13. The apparatus as claimed in claim 11 wherein the inside surface of the portion of RAM includes an adhesive film.

14. The apparatus as claimed in claim 11 wherein the portion of RAM overlaps only a portion of the component part.

15. The apparatus as claimed in claim 11 wherein an edge of the portion of RAM is tapered.

16. The apparatus as claimed in claim 11 wherein the portion of RAM is made from a non-electrically conductive polymer with dispersed particles of conductive particles.

17. The apparatus as claimed in claim 11 wherein the component part is made from composite layers of polymer or resin-impregnated fibers.

18. The apparatus as claimed in claim 11 including a vacuum bag to pressure bond the inside surface of the portion of RAM to the outside of the component part.

19. The apparatus as claimed in claim 11 including a screw or rivet to reinforce the composite laminate structure with co-laminated radar absorbing material.

20. An apparatus comprising:

a portion of radar absorbing material (RAM) having an inside surface and an outside surface;

a first component part fabricated from composite laminate and having an inside surface and an outside surface, the first component part being positioned adjacent to the portion of RAM; and a second component part fabricated from composite laminate and having an inside surface and an outside surface, the outside surface of the second component part being pressure bonded to the inside surface of the portion of RAM and the inside surface of the first component part to form a composite laminate structure with co-laminated radar absorbing material.

* * * * *